US005973605A

United States Patent [19]

Yamanashi

[11] Patent Number: 5,973,605

[45] Date of Patent: Oct. 26, 1999

[54] THERMISTOR MONITOR SYSTEM

[75] Inventor: Hidenori Yamanashi, Shizuoka-ken, Japan

[73] Assignee: Yazaki Corporation, Tokyo, Japan

[21] Appl. No.: 08/994,645

[22] Filed: Dec. 19, 1997

[30] Foreign Application Priority Data

Dec. 20, 1996 [JP] Japan ..... 8-341605

[51] Int. Cl.[6] ..... G08B 21/00

[52] U.S. Cl. ..... 340/653; 340/655; 340/657; 340/584; 340/622

[58] Field of Search ..... 340/653, 655, 340/657, 584, 589, 622, 825.17, 815.43, 815.45; 338/22 R; 323/369

[56] References Cited

U.S. PATENT DOCUMENTS 4,672,315 6/1987 Heinzler et al. ..... 340/653

5,349,336 9/1994 Nishiura et al. ..... 340/653

5,769,705 6/1998 O'Callaghan et al. ..... 454/184

FOREIGN PATENT DOCUMENTS 59-176189 11/1984 Japan .

*Primary Examiner*—Daniel J. Wu

*Assistant Examiner*—Toan N. Pham

*Attorney, Agent, or Firm*—Finnegan, Henderson, Farabow, Garrett & Dunner, L.L.P.

[57] ABSTRACT

A combination of circuits is responsive to a respective one of a definite number of operation patterns of a plurality of PTCs, the operation patterns being different therebetween and including a plurality of first patterns each respectively representative of an operating state of a corresponding PTC thermally operated, for providing a signal with a corresponding one of a definite number of signal states representing the operation patterns, respectively, and a common LED is operable by the signal with a respective signal state to provide an identifiable indication relative to an indication by the signal with any other signal state.

12 Claims, 4 Drawing Sheets

| | RESISTANCE RATIO | COLOR |
|---|---|---|
| $R_1 : R_2$ | 500 : OPEN | RED |
| $R_3 : R_4$ | 500 : 500 | YELLOW |
| $R_5 : R_6$ | OPEN : 500 | GREEN |

THERMISTOR MONITOR SYSTEM

BACKGROUND OF THE INVENTION

1. Field of the Invention

The present invention generally relates to a thermistor (thermally sensitive resistor) monitor system, and particularly, it relates to a monitor system a light emitting diode (hereafter "LED") for monitoring a thermistor network composed of a plurality of thermistors of a kind, such as a positive temperature coefficient thermistor (hereafter "PTC"), a critical temperature resistor (hereafter "CTR") or a negative temperature coefficient thermister (hereafter "NTC"), to display an operating state of the thermistor network, indicating, if any, a thermistor having a significantly changed resistance relative to a normal state in an identifiable manner.

2. Description of Relevant Art

The thermistor is a collective nomenclature of electronic components each respectively comprising a semiconductor extremely sensitive to its temperature so that its electric resistance greatly changes in dependence on the temperature relative to a state in a temperature range under a normal working condition, and has a non-linear temperature coefficient that is positive in PTC or negative in NTC or suddenly drops in CTR at a critical temperature.

The thermistor has a wide range of applications, where it is frequently employed in the form of a network to be monitored with one or more LEDs. Such a thermistor network comprises a plurality of identical thermistors with or without interconnections therebetween.

For example, a PTC network is employed for protection of loads in an electrical system, and occasionally some PTCs conduct large currents due such as to faulty loads that may be short-circuited, having their temperatures increased, entering their apparent open states to interrupt current conduction therethrough. Such a PTC network needs monitoring in a manner identifiable of a respective PTC automatically operated to be apparently open.

FIG. 1 shows a conventional PTC monitor system in a simplified form, and FIG. 2, another conventional PTC monitor system.

The conventional system of FIG. 1 comprises a pair of monitor circuits 2*a*+3*a*, 2*b*+3*b* each comprised of an LED 2*a* or 2*b* and a resistor 3*a* or 3*b* connected in series. The monitor circuits 2*a*+3*a*, 2*b*+3*b* are each connected across a corresponding one of two PTCs 1*a*, 1*b* that are installed in a pair of electric circuits connected in parallel between a power supply and a ground. The electric circuits are each constituted with an electric load 4*a* or 4*b*, and one PTC 1*a* or 1*b* is connected thereto in series.

If the PTC 1*a* or 1*b* is operated with e.g. a short-circuit in associated load, a corresponding one 2*a* or 2*b* of the two LEDs has a changed brightness with a varied current conducted therethrough, thereby indicating an operating state of the PTC 1*a* or 1*b*.

The conventional system of FIG. 2 also monitors two PTCs 1*a*, 1*b* that are installed in a pair of electric circuits connected in parallel between a power supply and a ground, which electric circuits are each constituted with an electric load 4*a* or 4*b*. This system however comprises a single monitor circuit comprised of an LED 2 and a resistor 3 connected thereto in series. The monitor circuit is connected at its positive pole end to a power supply end of each PTC 1*a*, 1*b* and at its negative pole end via a forward diode 5*a*, 5*b* to a load end of the PTC 1*a*, 1*b*

If either PTC 1*a* or 1*b* is operated, the LED 2 has a changed brightness, indicating an operating state of a combination of the PTCs 1*a* and 1*b*.

In the former system, two PTCs are individually monitored by two LEDs, which means any increase in number of PTCs requires an identical increase in number of LEDs, causing an undesirable increase in number of circuit components accompanying a dear cost.

In the latter system, two PCTs are monitored with a common single LED failing to identify which PTC is operated to be apparently open.

Similar circumstances appear with respect to other thermistors.

SUMMARY OF THE INVENTION

The present invention has been achieved with such points in view.

It therefore is an object of the present invention to provide a monitor system including a common LED for monitoring a thermistor network, permitting an operated thermistor to be identified.

To achieve the object, a first aspect of the invention provides a monitor system (FIGS. 3–6) for monitoring a network composed of a total of N thermistors (1*a*, 1*b*; 1*a*, 1*b*, 1*c*; 101*a*, 101*b*, 101*c*) each respectively having a first state, when normally working, and a second state, when thermally operated, where N is an arbitrary integer, the monitor system comprising: a common LED (2) operable with an arbitrary one of a total of M different currents conducted therethrough to display a working state of the network in a corresponding one of a total of M different manners, where M is an integer equal to or larger than N; and circuitry means (10*a*, 10*b*, 11*a*, 11*b*; 6*a*, 6*b*, 6*c*, 7*a*, 7*b*, 7*c*, 10*a*, 10*b*, 10*c*) connected between the common LED and the N thermistors for conducting the arbitrary current through the common LED, as an identified one of the N thermistors has the second state thereof.

According to the first aspect, a thermistor network is composed of N thermistors, and a common LED is operable with any of M different currents to display a working state of the thermistor network in one of M different manners, where M is not smaller than N.

Accordingly, N of the M different manners are employable to display N different states of the network each respectively representative of an identified thermistor thermally operated.

According to a second aspect (FIGS. 3–6) of the invention: M is larger than N; the circuitry means conducts a certain one of the M different currents through the common LED, as the N thermistors have the first states thereof; and the common LED displays the working state of the network in a certain one of the M different manners.

According to the second aspect, the common LED displays a normal state of the thermistor network in a manner different from the N manners employed for displaying thermally operated states of the N thermistors.

According to a third aspect (FIGS. 3–6) of the invention, the circuitry means comprises a total of N electric circuits (10*a*, 10*b*, 11*a*, 11*b*; 6*a*, 6*b*, 6*c*, 7*a*, 7*b*, 7*c*, 10*a*, 10*b*, 10*c*) having the N thermistors (1*a*, 1*b*; 1*a*, 1*b*, 1*c*; 101*a*, 101*b*, 101*c*) connected any in all thereof; and the N electric circuits are cooperative with each other to have one of a total of N different circuit resistances connected to the common LED, as the identified thermistor has the second state.

According to the third aspect, the circuitry means connected between the common LED and the N thermistors comprises N electric circuits having the N thermistors connected any in all thereof. The thermistors working as resistances cooperate with the electric circuits to constitute a circuit network equivalent to an impedance serially connected to the common LED between a power supply and one of a load network or a grounded potential, as the load network may constitute part of the circuit network. In such the circuit network, an identified thermistor is thermally operated. Then, the equivalent impedance has one of N different circuit resistances connected to the common LED. Such a circuit network may preferably be designed with the N electric circuits composed of N different resistances, respectively.

Moreover, to achieve the object described, a fourth aspect (FIGS. 3, 4) of the invention provides a PTC monitor system for monitoring a plurality of PTCs (1*a*, 1*b*; 1*a*, 1*b*, 1*c*), the system comprising circuitry means (10*a*, 10*b*, 11*a*, 11*b*; 6*a*, 6*b*, 6 *c*, 7*a*, 7*b*, 7*c*, 10*a*, 10*b*, 10*c*) responsive to a respective one of a definite number of operation patterns of the PTCs different therebetween and including a plurality of first patterns each respectively representative of an operating state of a corresponding PTC (1*a*, 1*b*; 1*a*, 1*b*, 1*c*) thermally operated, for providing a signal with a corresponding one of a definite number of signal states representing the operation patterns, respectively, and a common LED (2) operable by the signal with a respective signal state to provide an identifiable indication relative to an indication by the signal with any other signal state.

According to the fourth aspect, a plurality of PTCs are monitored by a common LED operable by a signal generated in circuitry therefor.

An entirety of the PTCs has a definite number of operation patterns, one of which may represent a collective normal state of the whole PTCs, another may represent a collective operated state of some PTCs, and another may represent an operated state of a certain PTC. Anyhow, the definite number of operation patterns are different therebetween, i.e. do not take place concurrently, and include a plurality of first patterns of which a respective one is representative of an operating state of a thermally operated corresponding PTC, i.e. an operated state thereof.

On the other hand, the above-mentioned signal can have one of a definite number of signal states that represent the operation patterns, respectively.

The circuitry is responsive to a respective operation pattern to provide the signal with a corresponding signal state.

The common LED is operable by the signal with a respective one of the definite number of signal states, to provide an indication identifiable from an indication by the signal with any of the remaining signal states. The identification may be by a brightness, a color or any other applicable coding, alone or in combination.

If any PTC is thermally operated, the circuitry responds thereto to provide the signal with a corresponding signal state, whereby the common LED is operated to provide an identifiable indication representative of an operated state of that PTC.

Accordingly, a plurality of PTCs are monitored by a common LED permitting an identifiable indication of an operating state of any thermally operated PTC.

According to a fifth aspect (FIGS. 3, 4) of the invention, the definite number of operation patterns further include a second pattern representative of a normal operating state of the PTCs (1*a*, 1*b*; 1*a*, 1*b*, 1*c*).

According to the fifth aspect, the common LED is permitted to provide an identifiable indication that collectively represents the whole PTCs in their normal operating states.

According to a sixth aspect (FIGS. 3, 4) of the invention, the circuitry means comprises a plurality of first circuits (10*a*, 10*b*; 10*a*, 10*b*, 10*c*) for interconnections at a polarity (+) end between the common LED (2) and the PTCs (1*a*, 1*b*; 1*a*, 1*b*, 1*c*), and a plurality of second circuits (11*a*, 11*b*; 6*a*/7*a*, 6*b*/7*b*, 6*c*/7*c*) for interconnections at an opposite polarity (−) end therebetween, and a respective second circuit (11*a*, 11*b*; 6*a*/7*a*, 6*b*/7*b*, 6*c*/7*c*) has a resistor (3*a*, 3*b*; 9*a*/9*b*, 9*c*/9 *d*, 9*e*/9*f*) therefor and a diode (5*a*, 5*b*; 8*a*/8*b*, 8*c*/8*d*, 8*e*/8*f*) therefor connected in series.

According to the sixth aspect, there is provided a circuit constitution that permits a necessary number of different operation patterns of the whole PTCs to be detected without a redundant circuit.

According to a seventh aspect (FIGS. 3, 4) of the invention, the resistors (3*a*, 3*b*; 9*a*/9*b*, 9*c*/9*d*, 9*e*/9*f*) of different second circuits (11*a*, 11*b*; 6*a*/7*a*, 6*b*/7*b* , 6*c*/7*c*) have resistances (R1, R2; R1/R2, R3/R4, R5/R6) thereof different therebetween.

According to the seventh aspect, the signal is permitted to have a necessary number of different signal states established simply by substitution of a sum of currents conducted through the common LED.

Upon a thermal operation of any PTC, the total current is allowed to vary in an identifiable manner, in accordance with a contribution of an associated current conducted through a corresponding second circuit, as the whole PTCs may have their resistances substantially equivalent under a given circumstance.

According to an eithth aspect (FIG. 3) of the invention, the identifiable indication comprises an identifiable brightness.

According to a ninth aspect (FIG. 4) of the invention, the identifiable indication comprises an identifiable brightness.

Further, to achieve the object described, a tenth aspect (FIGS. 3, 4) of the invention provides a PTC monitor system for monitoring a first PTC (1*a*; 1*a*) and a second PTC (1*b*; 1*b*, 1*c*) to indicate an operating state thereof on a common LED (2), the system comprising a first circuit (2+10*a*+11*a*; 2+10*a*+6*a*/7*a*) connected in parallel to the first PTC (1*a*; 1*a*), the first circuit (10*a*+11*a*; 10*a*+6*a*/7*a*) having the common LED (2), a first diode (5*a*; 8*a*/8*b*) and a first limiting resistor (3*a*; 9*a*/9*b*) connected in series, an interconnection (10*b*; 10*b*, 10*c*) between an upstream end (+) of the common LED (2) and an upstream end (+) of the second PTC (1*b*; 1*b*, 1*c*), and a second circuit (11*b*; 6*b*/7*b*, 6*c*/7*c*) for connecting a downstream end (−) of the common LED (2) to a downstream end (−) of the second PTC (1*b*; 1*b*, 1*c*) via a second diode (5*b*; 8*c*/8*d*, 8*e*/8*f*) and a second limiting resistor (3*b*; 9*c*/9*d*, 9*e*/9*f*).

According to the tenth aspect, there can be achieved similar effects to the first to the sixth aspect.

According to an eleventh aspect (FIGS. 3, 4) of the invention, the first and second limiting resistors (3*a*, 3*b*; 9*a*/9*b*, 9*c*/9*d*, 9*e*/9*f*) are different from each other in resistance (R1, R2; R1/R2, R3/R4, R5/R6).

According to the eleventh aspect, there can be achieved similar effects to the seventh aspect.

According to a twelfth aspect (FIG. 4) of the invention, the common LED (2) is adaptive for a first indication (RED) and a second indication (YELLOW, GREEN) different from each other in color, and the common LED (2) has at the downstream end (−) thereof a first terminal (6) responsible for the first indication (RED) and connected via the first diode (8a) and the first limiting resistor (9*a*) to a downstream end (–) of the first PTC (1*a*) and via a third diode (8*c*, 8*e*) and a third limiting resistor (9*c*, 9*e*) to the downstream end (–) of the second PTC (1*b*, 1*c*), and a second terminal (7) responsible for the second indication (YELLOW, GREEN) and connected via the second diode (8*b*) and the second limiting resistor (9*b*) to the downstream end (–) of the first PTC (1*a*) and via a fourth diode (8*d*, 8*f*) and a fourth limiting resistor (9*d*, 9*f*) to the downstream end (–) of the second PTC (1*b*, 1*c*).

According to the twelfth aspect, an effective color coding is allowed for, as the system may concurrently monitor a third PTC in a similar manner to the second PTC, permitting an intermediate color tone to be employed, such as a yellow between a red and a green.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
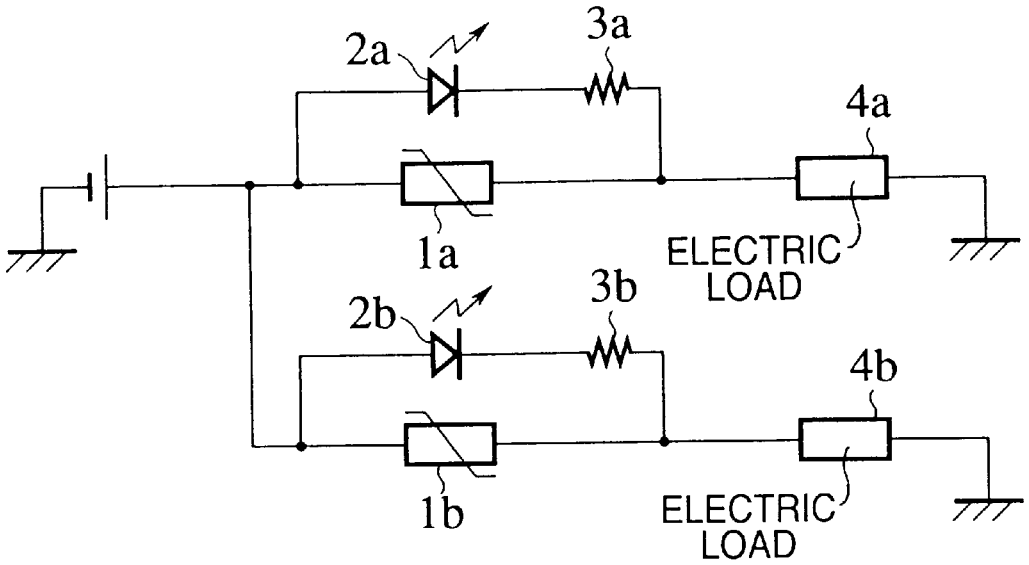
FIG.1 PRIOR ART
FIG. 1 is a circuit diagram of a conventional PTC monitor system, as it is applied to a typical circuit system having a pair of PTCs for protection.
Figure 2:
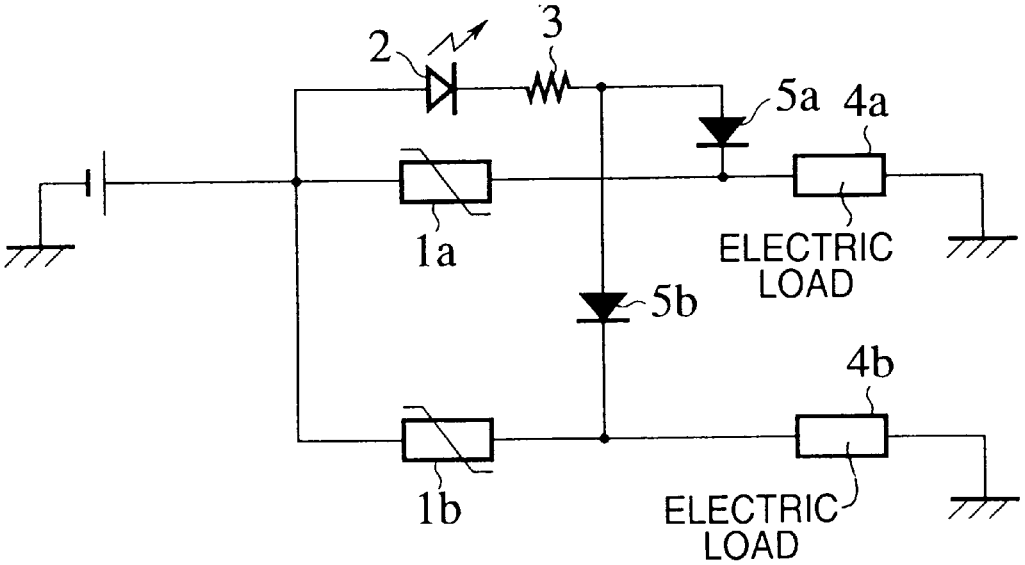
FIG.2 PRIOR ART
FIG. 2 is a circuit diagram of another conventional PTC monitor system, as it is applied to like circuit system to FIG. 1.

There will be detailed below the preferred embodiments of the present invention with reference to the accompanying drawings. Like members are designated by like reference characters.

Figure 3:
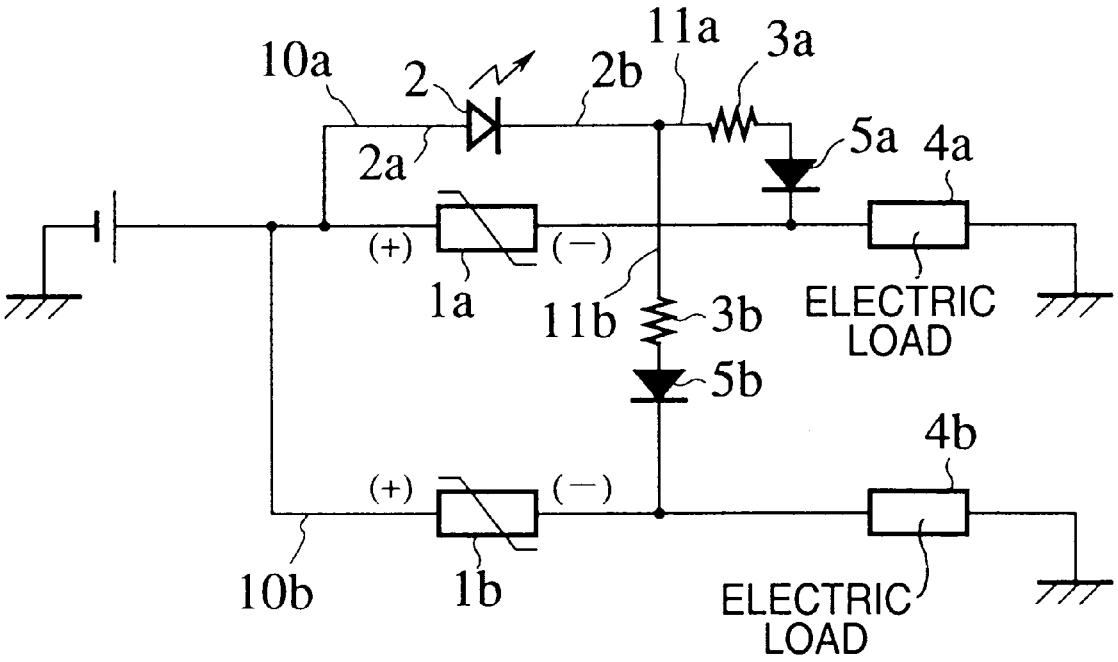
FIG. 3 is a circuit diagram of a PTC monitor system according to an embodiment of the invention, applied to like circuit system to FIG. 1.

FIG. 3 shows a PTC monitor system according to a first embodiment of the invention.

As shown in FIG. 3, the PTC monitor system comprises an LED 2 connected at a positive pole 2*a* end thereof via a conductor circuit 10*a* to a positive pole (+) end of a first PTC 1*a* and via another conductor circuit 10*b* to a positive pole (+) end of a second PTC 1*b*, and a pair of branch circuits 1*a*, 11*b* interconnecting a negative pole 2*b* end of the LED 2 with respective negative pole (–) ends of the first and second PTCs 1*a*, 1*b*. The branch circuits 11*a*, 11*b* are comprised of limiting resistors 3*a*, 3*b* and diodes 5*a*, 5*b* connected in series, respectively. The diodes 5*a*, 5*b* as well as the LED 2 have their forward directions in accord with senses of electric currents to be conducted therethrough.

In other words, the system is constituted with a serial circuit comprised of LED 2, resistor 3*a* and diode 5*a* and connected in parallel to the first PTC 1*a*, while the LED 2 is connected at its downstream end 2*b* via resistor 3*b* and diode 5*b* to a downstream end (–) of the second PTC 1*b*.

The resistors 3*a*, 3*b* have their resistances R1, R2 different from each other. The resistances R1, R2 are sufficiently larger than inner resistances of the LED 2 and diodes 5*a*, 5*b*, respectively, to assure stable performances of these elements.

The first and second PTCs 1*a*, 1*b* comprise thermally sensitive diodes having an identical internal resistance under a given circumstance with a substantially uniform temperature distribution. The resistances in LED 2 and diodes 5*a*, 5*b* are very small and substantially insensitive to the ambient temperature.

The first and second PTCs 1*a*, 1*b* are installed in first and second electric circuits connected between a power supply and a ground, respectively. The first and second electric circuits have first and second electric loads 4*a*, 4*b* connected in series to the PTC, respectively. The loads 4*a*, 4*b* have their resistances by far larger than inner resistances of the PCTs 1*a*, 1*b*, respectively. The loads 4*a*, 4*b* are substantially identical in resistance for comprehension, but may not be so. The PTCs 1*a*, 1*b* individually protect the electric circuits against an over-current due to a short-circuit fault at the load 4*a* or 4*b*.

While the PTCs 1*a*, 1*b* are in their normal working states, the electric circuits to be protected have substantially even voltage drops across the PTCs 1*a*, 1*b*, respectively, as the resistances R1, R2 are so designed in consideration of an entire circuit network including the PTCs and LED, i.e. taking into account resistances of all associated electrical elements, such as elements 1*a*, 1*b*, 2, 4*a*, 4*b*, 5*a*, and 5*b*, and circuit impedances. Then, the LED 2 has a relatively small normal current conducted therethrough, which is shared substantially in a proportion of R2:R1 to run through the resistors 3*a*, 3*b*. The LED 2 gives an indication with a normal low brightness corresponding to the normal current.

If e.g. the first load 4*a* faults, a short-circuit current is conducted through the first PTC 1*a,* i.e. through the thermally sensitive semiconductor in this PTC, giving a sudden temperature rise to the semiconductor, which thus has its resistance quickly increased to be apparently open. As the first circuit is shorted at the load 4*a* and the second circuit provided with the load 4*b* is normal, a power supply voltage is imposed on a serial connection of the LED 2, resistor 3*a* and diode 5*a* and is substantially born by a voltage drop across the resistor 3*a* of resistance R1, so that a relatively large corresponding current is conducted through the LED 2, which is thus luminous with a relatively high brightness.

Also in the case the second load 4*b* is faulty, the LED 2 has a relatively large current conducted therethrough substantially in dependence on the resistance R2 of the resistor 3*b*. However, as this resistance R2 is different from the resistance Ri, the conducted current in this case is different from that in the case of a fault at the load 4a, and the LED 2 has a different brightness.

When a display plate of the LED 2 is illuminated by a light emitting element therein with one of two different intensities of brightness, one can tell at a glance which PTC 1*a* or 1*b* is thermally operated, i.e. which load 4*a* or 4*b* is faulty, and will take prompt measures to repair the faulty load 4*a* or 4*b*.

The resistances R1 and R2 may preferably be designed in a ratio range of R1/R2 near 1/2 to permit a better decision when telling either brightness from the other.

Resistance values of R1 and R2 may preferably be set in dependence of capacities or performances of the LED 2, e.g. between 200 Ω to 300 Ω for R1 and 200 Ω to 600 Ω for R2. Small resistances conduct large currents so that the LED 2 may be saturated, with a difficulty in decision for a different brightness. Large resistances conduct small currents so that the LED 2 may have an insufficient brightness for the monitoring to be smooth.

According to the first embodiment, a pair of PTCs 1*a*, 1*b* are monitored with a brightness-coded PTC monitor system having a single common LED 2 permitting a decision by brightness as to which PTC 1*a* or 1*b* is thermally operated.

Figures 4, 5:
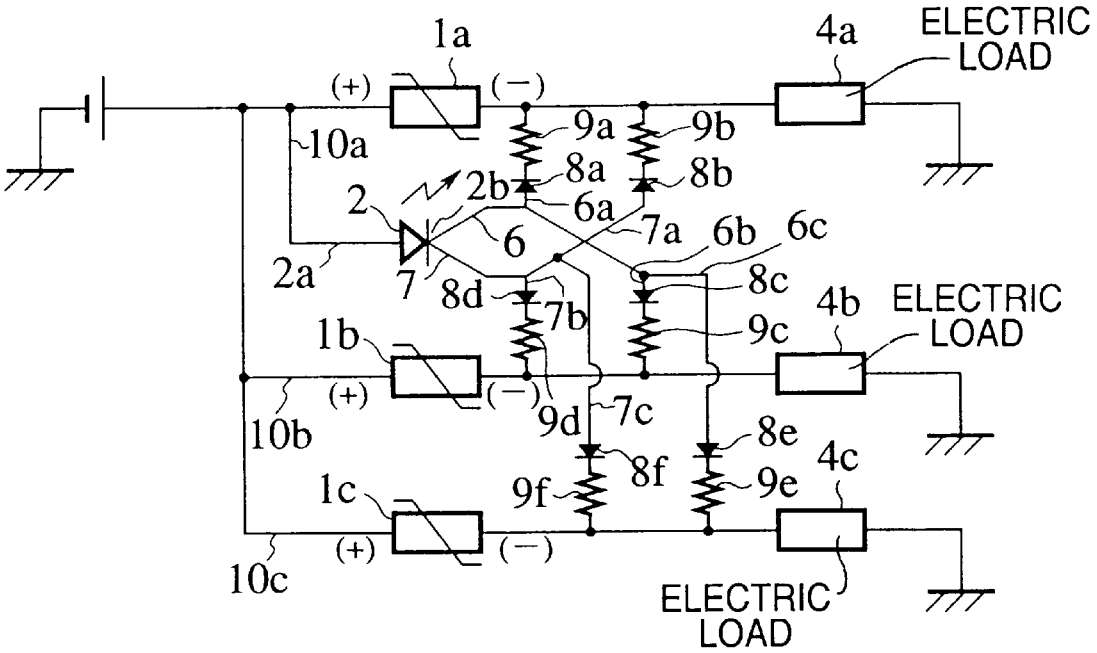
FIG. 4 is a circuit diagram of a PTC monitor system according to another embodiment of the invention, as it is applied to another typical circuit system having a triple of PTCs for protection.
FIG. 5 is a table of relationships between resistance ratios and display colors of the system of FIG. 4.

FIG. 4 shows a color-coded PTC monitor system according to a second embodiment of the invention, as it is applied to a triple of first, second and third PTCs 1*a*, 1*b*, 1*c* installed in an electrical system composed of first, second and third electric circuits having a triple of loads 4*a*, 4*b*, 4*c* protected by the PTCs 1*a*, 1*b*, 1*c* serially connected thereto, respectively. FIG. 5 lists relationships between resistance ratios and display colors of the monitor system of FIG. 4.

As shown in FIG. 4, the PTC monitor system employs a common LED 2 of a current-controlled dichromatic type adaptive for a color coding using a pair of primary colors or a red and a green, and a mixed color tone therebetween or a yellow. Color tone control is effected with a ratio between currents conducted through an R(red) terminal 6 and a G(green) terminal at a negative pole 2*b* end of the LED 2. The R and G terminals 6, 7 are connected via diodes 8*a*, 8*b*; 8*c*, 8*d*; 8*e*, 8*f* and limiting resistors 9*a*, 9*b*; 9*c*, 9*d*; 9*e*, 9*f* to negative (−) pole ends of the first, second and third PTCs 1*a*, 1*b*, 1*c*, respectively.

More specifically, the PTC monitor system comprises the LED 2 connected at a positive pole 2*a* end thereof via a conductor circuit 10*a* to a positive pole (+) end of the first PTC 1*a*, via another conductor circuit 10*b* to a positive pole (+) end of the second PTC 1*b*, and via still another conductor circuit 10*c* to a positive pole (+) end of the third PTC 1*c*, and a pair of triples of branch circuits 6*a*, 6*b*, 6*c*; 7*a*, 7*b*, 7*c* interconnecting the negative pole 2*b* end of the LED 2 with the respective negative pole (−) ends of the first, second and third PTCs 1*a*, 1*b*, 1*c*. The branch circuits 6*a*, 6*b*, 6*c*; 7*a*, 7*b*, 7*c* are comprised of the diodes 8*a*, 8*c*, 8*e*; 8*b*, 8*d*, 8*f* and the limiting resistors 9*a*, 9*c*, 9*e*; 9*b*, 9*d*, 9*f* connected in series, respectively. The diodes 8*a* to 8*f* as well as the LED 2 have their forward directions in accord with senses of electric currents to be conducted therethrough. The connections for the R and G terminals 6, 7 may be interchanged.

As listed in FIG. 5, the limiting resistors 9*a*, 9*b*; 9*c*, 9*d*; and 9*e*, 9*f* in connections from the R and G terminals to the first, second and third electric circuits have their resistances R1, R2; R3, R4; and R5, R6 set in proportions R1 to R2; R3 to R4; and R5 to R6 of a 500 to an apparent open; a 500 to a 500; and an apparent open to a 500 for a red indication of the first PTC 1*a*, a yellow indication of the second PTC 1*b*, and a green indication of the third PTC 1*c*, respectively. The resistance proportions may however be otherwise determined for other combinations of different color tones.

According to the second embodiment using a dichromatic LED, possible variations of color tones allow a multiplicity of PTCs to be monitored in an identifiable manner.

In the foregoing embodiments, there are assumed lowest numbers of PTCs to be monitored, simply for comprehension. It however will be seen that the number of PTCs may be increased to be monitored by a common LED in a similar manner, i.e. by connecting the common LED in parallel to the respective PTCs, with an increased number of connection circuits therebetween each including a different resistance and a reverse current preventing element connected in series in a substantial sense.

An entirety of such connection circuits may be designed as adequate circuitry in consideration of associated electric circuits where the PTCs are installed for their protection.

Therefore, a PTC monitor system for monitoring a plurality of PTCs according to the invention may comprise: circuitry responsive to a respective one of a definite number of operation patterns of the PTCs, that are different therebetween and include a plurality of first patterns each respectively representative of an operating state of a corresponding PTC thermally operated, for providing a signal with a corresponding one of a definite number of signal states representing the operation patterns, respectively; and a common LED operable by the signal with a respective signal state to provide an identifiable indication relative to an indication by the signal with any other signal state.

Further, in such the PTC monitor system, the definite number of operation patterns may preferably include a second pattern representative of a normal operating state of the PTCs.

Figure 6:
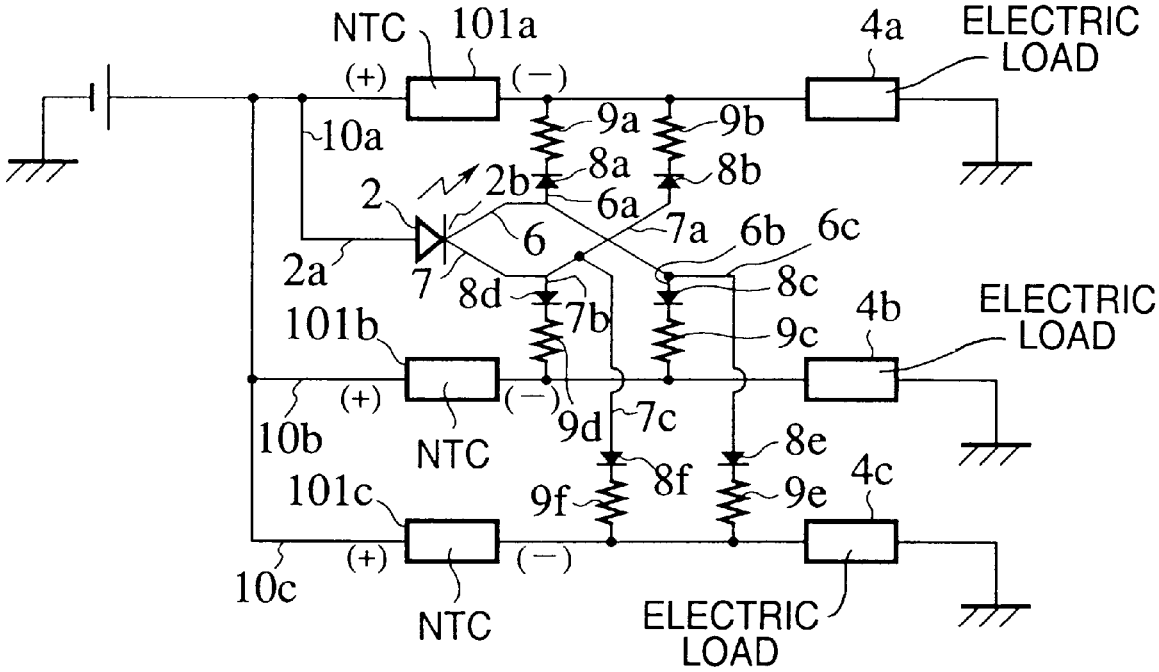
FIG. 6 is a circuit diagram of a monitor system for monitoring a triple of NTCs according to another embodiment of the invention.

FIG. 6 shows an NTC monitor system according to a third embodiment of the invention, as it is applied to a triple of NTCs 101*a*, 101*b*, 101*c* that may be installed as energy supplying temperature detectors in an electrical system having a triple of thermally sensitive loads 4*a*, 4*b*, 4*c* placed under different circumstances and individually adapted to work in a temperature range exceeding a threshold, consuming progressively increased energy.

The third embodiment is identical in circuit arrangement to the second embodiment, as well as the use of a current-controlled dichromatic common LED 2.

The NTCs may be replaced by a triple of CTRs.

According to an aspect common to the foregoing embodiments, a monitor system is provided for monitoring a network composed of a total of N thermistors each respectively having a first state, when normally working, and a second state, when thermally operated, where N is an arbitrary integer, and comprises: a common LED operable with an arbitrary one of a total of M different currents conducted therethrough to display a working state of the network in a corresponding one of a total of M different manners, where M is an integer equal to or larger than N; and circuitry means connected between the common LED and the N thermistors for conducting the arbitrary current through the common LED, as an identified one of the N thermistors has the second state thereof.

The numeral M may preferably be larger than the N, the circuitry means may conduct a certain one of the M different currents through the common LED, as the N thermistors have the first states thereof, and the common LED may display the working state of the network in a certain one of the M different manners.

The circuitry means may comprise a total of N electric circuits having the N thermistors connected any in all thereof, and the N electric circuits may be cooperative with each other to have one of a total of N different circuit resistances connected to the common LED, as the identified thermistor has the second state.

A total of M-N-1 different manners of LED display may be employed for a positive indication of a set of normally working thermistors, a set of thermally operated thermistors, or a sum set of a set of normally working thermistors and a set of thermally operated thermistos, as circumstances require.

While preferred embodiments of the present invention have been described using specific terms, such description is for illustrative purposes, and it is to be understood that changes and variations may be made without departing from the spirit or scope of the following claims.

What is claimed is:

1. A monitor system for monitoring a network composed of a total of N thermistors each respectively having a first state, when normally working, and a second state, when thermally operated, where N is an arbitrary integer, the monitor system comprising:

a common LED operable with an arbitrary one of a total of M different currents conducted therethrough, for indication in a corresponding one of a total of M different manners, where M is an integer equal to or larger than N; and circuitry means connected between the common LED and the total of N thermistors, the circuitry means being adapted, wherein when an identified one of the total of N thermistors is in the second state thereof, the circuitry means conducts a corresponding one of the total of M different currents through the common LED, and wherein when another identified one of the total of N thermistors is in the second state thereof, the circuitry means conducts another corresponding one of the total of M different currents through the common LED.

2. A monitor system according to claim 1, wherein:

M is larger than N; and the circuitry means conducts a certain one of the total of M different currents through the common LED when the total of N thermistors are in the first states thereof.

3. A monitor system according to claim 1, wherein:

the circuitry means comprises a total of N electric circuits having the total of N thermistors connected therein; and the total of N electric circuits are cooperative with each other, when the identified thermistor is in the second state thereof, to have a corresponding one of a total of N different circuit resistances connected to the common LED, and when the another identified thermistor is in the second state thereof, to have another corresponding one of the total of N different circuit resistances connected to the common LED.

4. A PTC monitor system for monitoring a plurality of PTCs, the system comprising:

circuitry means responsive to a respective one of a definite number of operation patterns of the plurality of PTCs for providing a signal with a corresponding one of a definite number of signal states representing the definite number of different operation patterns, respectively, the definite number of different operation patterns including a plurality of different first patterns each respectively representative of a thermally operated state of a corresponding one of the plurality of PTCs; and a common LED operable by the signal with a respective one of the definite number of signal states to provide an identifiable indication relative to an indication by the signal with any of the other definite number of signal states.

5. A PTC monitor system according to claim 4, wherein the definite number of different operation patterns further include a second pattern representative of normal operating states of the plurality of PTCs.

6. A PTC monitor system according to claim 4 wherein:

the circuitry means comprises a plurality of first circuits for interconnections at a polarity end between the common LED and the PTCs, and a plurality of second circuits for interconnections at an opposite polarity end therebetween; and a respective second circuit has a resistor therefor and a diode therefor connected in series.

7. A PTC monitor system according to claim 6, wherein the resistors of different second circuits have resistances thereof different therebetween.

8. A PTC monitor system according to claim 4, wherein the identifiable indication comprises an identifiable brightness.

9. A PTC monitor system according to claim 4, wherein the identifiable indication comprises an identifiable color.

10. A PTC monitor system for monitoring a first PTC and a second PTC to indicate an operating state thereof on a common LED, the system comprising:

a first circuit connected in parallel to the first PTC, the first circuit having the common LED, a first diode and a first limiting resistor connected in series;

an interconnection between an upstream end of the common LED and an upstream end of the second PTC; and a second circuit for connecting a downstream end of the common LED to a downstream end of the second PTC via a second diode and a second limiting resistor.

11. A PTC monitor system according to claim 10, wherein the first and second limiting resistors are different from each other in resistance.

12. A PTC monitor system according to claim 10, wherein:

the common LED is adaptive for a first indication and a second indication different from each other in color; and the common LED has at the downstream end thereof a first terminal responsible for the first indication and connected via the first diode and the first limiting resistor to a downstream end of the first PTC and via a third diode and a third limiting resistor to the downstream end of the second PTC, and a second terminal responsible for the second indication and connected via the second diode and the second limiting resistor to the downstream end of the first PTC and via a fourth diode and a fourth limiting resistor to the downstream end of the second PTC.

* * * * *